US008845088B2

(12) United States Patent
Tsuchiya

(10) Patent No.: US 8,845,088 B2
(45) Date of Patent: Sep. 30, 2014

(54) PRINTER

(75) Inventor: Motohito Tsuchiya, Singapore (SG)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 90 days.

(21) Appl. No.: 13/597,581

(22) Filed: Aug. 29, 2012

(65) Prior Publication Data

US 2013/0057631 A1 Mar. 7, 2013

(30) Foreign Application Priority Data

Sep. 5, 2011 (JP) ..... 2011-193002

(51) Int. Cl.
*B41J 2/01* (2006.01)
*B41J 15/16* (2006.01)

(52) U.S. Cl.
CPC ..... *B41J 15/165* (2013.01)
USPC ..... 347/104; 347/101

(58) Field of Classification Search
None
See application file for complete search history.

(56) References Cited

FOREIGN PATENT DOCUMENTS

| | | | |
|---|---|---|---|
| JP | 63-282052 | 11/1988 | |
| JP | 11-199098 | 7/1999 | |
| JP | 2000-052613 | 2/2000 | |
| JP | 2003-335016 | * 11/2003 | ..... B41J 25/312 |
| JP | 2007-126230 | 5/2007 | |

OTHER PUBLICATIONS

Japanese Office Action for Japanese Patent No. 2011-193002 mailed on Jul. 23, 2013.
Chinese Office Action for Chinese Patent No. 2012-10324370.1 mailed on Jun. 12, 2014.
Japanese Office Action for Japanese Patent No. 2012-10324370.1 mailed on Jun. 12, 2014.

* cited by examiner

*Primary Examiner* — Geoffrey Mruk
(74) *Attorney, Agent, or Firm* — Amin, Turocy & Watson, LLP

(57) ABSTRACT

A printer comprises a paper holding section, a printing and conveying section, a buffer section and a movable section. The paper holding section holds the paper rolled into a roll such that can draw out and convey the paper. The printing and conveying section, which is provided with a print head and a platen roller that are arranged opposite to each other, draws out and conveys the paper and then prints on the paper. The buffer section arranged at the downstream side of the paper conveying direction of the paper holding section and the upstream side of the paper conveying direction of the printing and conveying section to elastically press the paper surface of the paper.

6 Claims, 7 Drawing Sheets

PRINTER

CROSS-REFERENCE TO RELATED APPLICATION

This application is based upon and claims the benefit of priority from Japanese Patent Application No. 2011-193002, filed Sep. 5, 2011, the entire contents of which are incorporated herein by reference.

FIELD

Embodiments described herein relate to a printer.

BACKGROUND

Conventionally, a printer is known which draws out and conveys the roll-shaped paper held by a paper holding section using a platen roller and then prints on the paper. In this printer, when the paper starts to be conveyed by the platen roller, due to the mass load of the roll section of the paper held by the paper holding section, the paper conveyed on the platen roller slides easily, which results sometimes in a degradation in print quality.

In order to inhibit the degradation in print quality, a printer is developed which is equipped with a buffer section that uses a propping member to press the paper drawn out from the paper holding section. When starting to convey paper, the buffer section counteracts the pull applied to the paper using a spring, thereby inhibiting the sliding of the paper conveyed on the platen roller.

DETAILED DESCRIPTION

In accordance with the embodiments described herein, a printer comprises a paper holding section, a printing and conveying section, a buffer section and a movable section. The paper holding section keeps the paper 2 rolled into a roll drawable and conveyable. The printing and conveying section, which is provided with a print head and a platen roller that are arranged opposite to each other, draws out and conveys the paper and then prints on the paper. The buffer section is arranged at the downstream side of the paper conveying direction of the paper holding section and the upstream side of the paper conveying direction of the printing and conveying section to elastically press the paper surface of the paper. The movable section equipped with the print head and the buffer section can rotate between a closing position opposite to the print head and the platen roller and an opening position that is located between the print head and the platen roller and is wider than the closing position.

The printer provided in the embodiments of the present invention is described below with reference to accompanying drawings.

Figure 1:
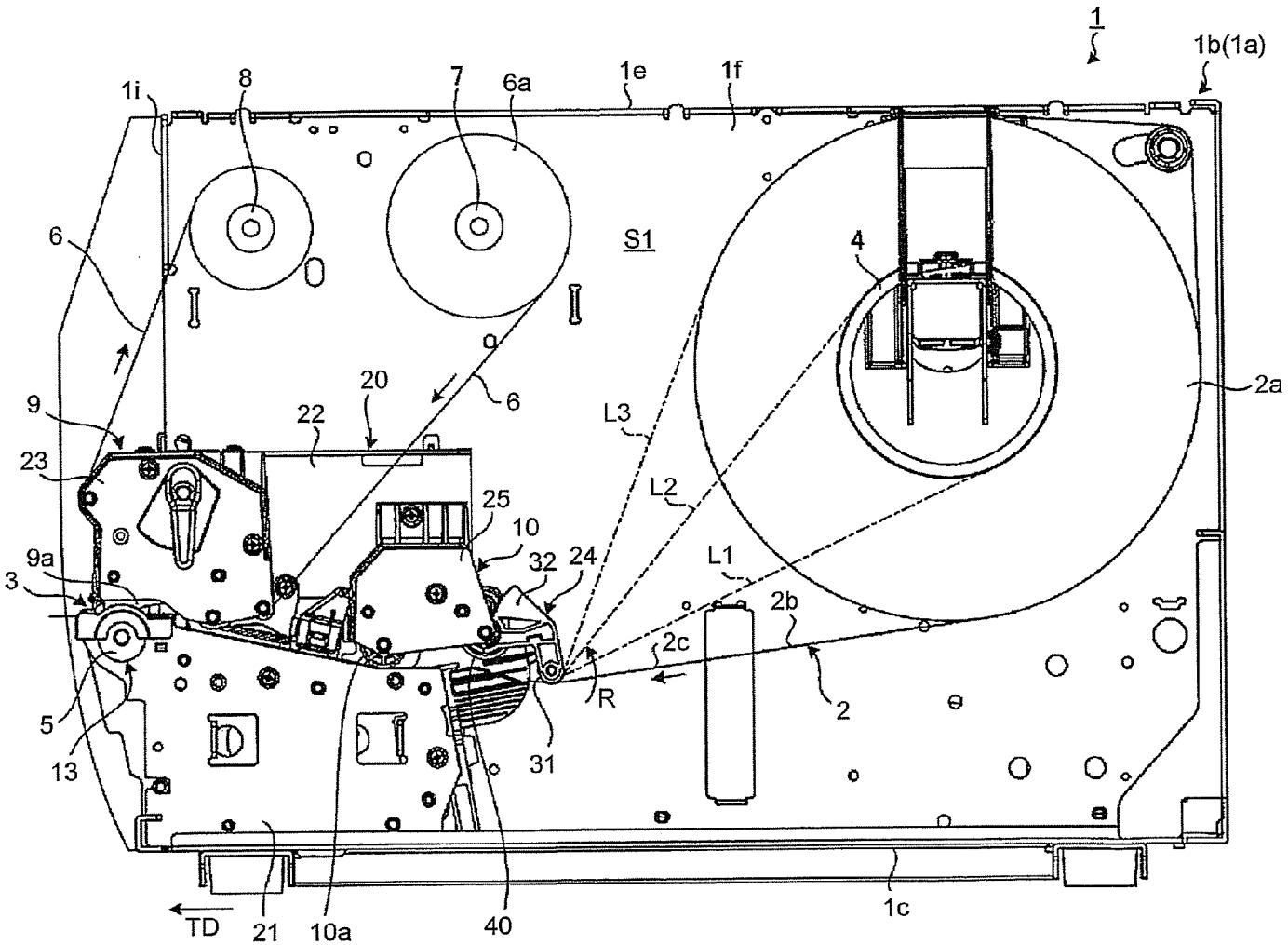
FIG. 1 is a lateral view showing an example of the internal structure of a printer according to an embodiment.

As shown in FIG. 1, the printer 1 holds the paper 2 rolled in a roll shape, draws out the paper 2 and prints on the paper 2 drawn out.

The paper 2 formed in a strip shape has a roll section 2*a* consisting of the paper rolled into the roll shape and a drawn-out section 2*b* consisting of the paper drawn out from the roll section 2*a*. In this embodiment, the paper 2 refers to label paper formed by adding a plurality of labels on a piece of backing paper. FIG. 1 shows an example of internally rolled paper rolled by taking a label as the inner side of a piece of backing paper. Moreover, the roll section 2*a* of the paper 2 represented by the solid line shown in FIG. 1 has a relatively large diameter. On the other hand, the dotted line L1 shown in FIG. 1 exemplarily shows the position of the paper 2 where the diameter of the roll section 2*a* becomes relatively small. Moreover, the dotted lines L2 and L3 shown in FIG. 1 exemplarily show the position of the paper 2 that is rolled into external roll paper by taking a label as the outer side of a backing paper. The line L2 exemplarily shows the position of the paper 2 where the diameter of the roll section 2*a* becomes relatively small, and the line L3 exemplarily shows position of the paper 2 where the diameter of the roll section 2*a* becomes relatively large. Moreover, the paper may also be continuous paper using no label, such as invoice paper.

Moreover, a variety of kinds of paper 2 with different widths orthogonal to the paper conveying direction TD may be optionally placed on the printer 1. The printer 1 is a printer of the called side-close configuration type that is configured on the edge at one side of the width direction of a paper conveying direction 3 in contrast to an edge part of the paper 2.

Figure 2:
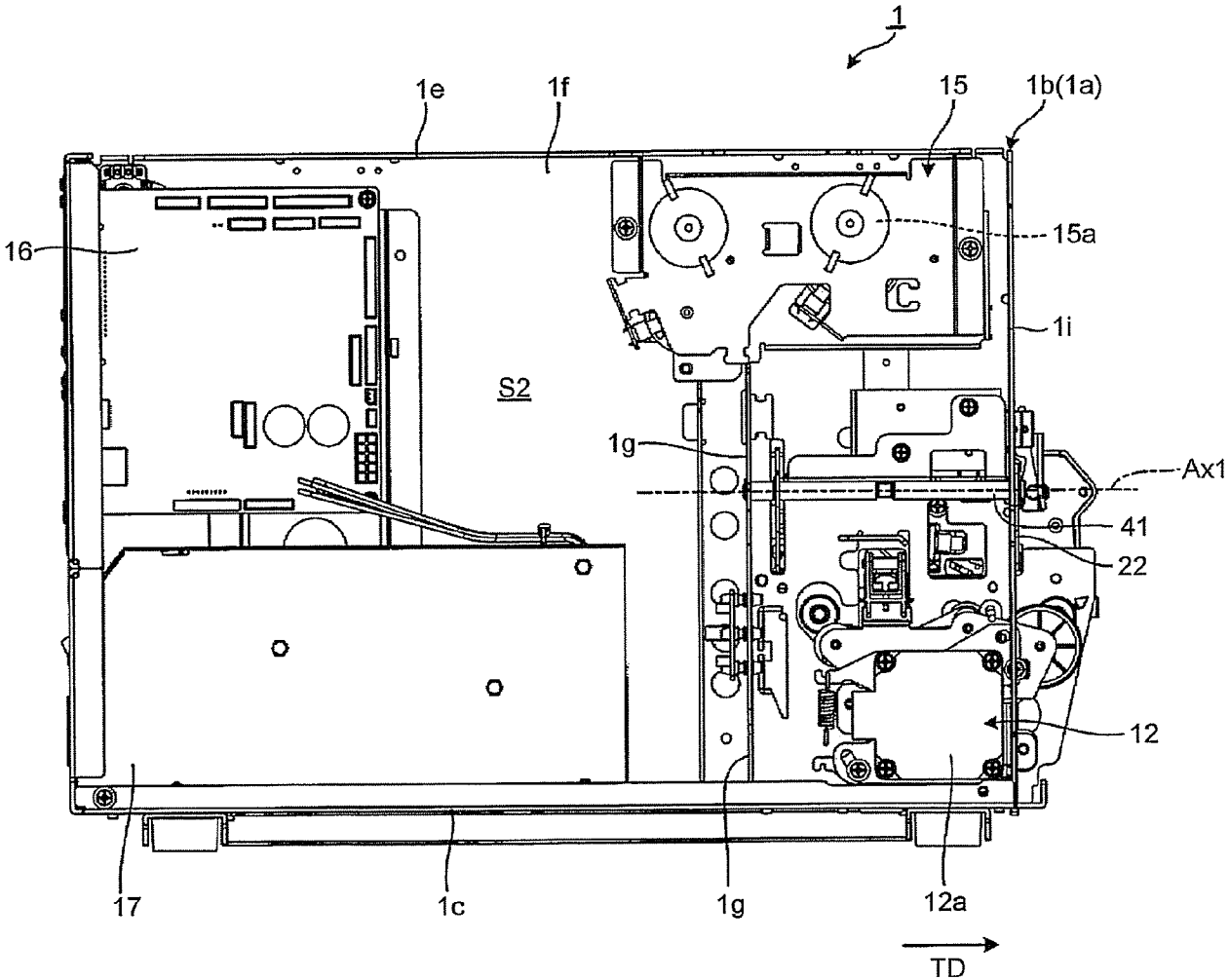
FIG. 2 is a lateral view showing an example of the internal structure of a printer according to an embodiment, observed from the opposite side of FIG. 1.

As shown in FIG. 1-FIG. 4, the main body part 1*a* of the printer 1 includes a housing 1*b* having a bottom wall 1*c*, a side wall 1*d* and a top wall 1*e* and a longitudinal wall 1*f* in the housing 1*b* that is vertical to the bottom side 1*e* but parallel to the side wall 1*d*. The inside of the housing 1*b* is divided into a first chamber S1 and a second chamber S2 by the longitudinal wall 1*f*. FIG. 1 shows the first chamber S1, and FIG. 2 shows the second chamber S2.

As shown in FIG. 1, in the first chamber S1, a paper holding shaft 4, a platen roller 5, the feed shaft 7 and the reeling shaft of an ink ribbon 6, a head block 9, a thermal head 9*a* arranged on the head block 9 and a roller block 10 are mounted on the longitudinal wall 1*f* in a gesture substantially vertical to the longitudinal wall 1*f*. The head block 10 and the roller block 10 are integrated to constitute a movable block 20 that serves as the movable section. Further, a fixed block 21, which faces the movable block 20 and is equipped with the platen roller 5, is arranged in the first chamber S1. Further, a paper conveying path 3 starting from the paper holding shaft 4 and passing the space between the fixed block 21 and the movable block 20 is also arranged in the first chamber S1.

The paper holding shaft 4 keeps the paper 2 rolled in a roller shape drawable and conveyable. Specifically, the paper holding shaft 4 keeps the roll section 2*a* of the paper 2 in a state capable of rotating around an axis vertical to the longitudinal wall 1*f*. Here, the paper holding shaft 4 may be rotationally held on the longitudinal wall 1*f* or fixed on the longitudinal wall 1*f*, and the roll section 2*a* of the paper 2 is kept in a state capable of rotating around the paper holding shaft 4. No matter which structure above is adopted, in this embodiment, the paper holding shaft 4 and the roll section 2*a* are not driven by a motor, instead, the rotation (slave drive) of the roll section 2*a* of the paper 2 is driven by the rotation of the platen roller 5 arranged at the downstream side (the left direction shown in FIG. 1) of the conveying direction, thereby drawing out the paper 2 from the roll section 2*a*. The paper holding shaft 4 is equivalent to the paper holding section.

The platen roller 5 is driven by the rotation of a first rotary driving section 12 (refer to FIG. 2) equipped with a step motor 12*a* (refer to FIG. 2), gears and a conveyer belt. The platen roller 5 is arranged opposite to the thermal head 9*a*. On the platen roller 5, the drawn-out section 2*b* of the paper 2 is pressed by the thermal head 9*a* to which an elastic member applies a force. With the structure above, the drawn-out section 2*b* of the paper 2 is clamped by the platen roller 5 and the thermal head 9*a*. Moreover, the platen roller 5 driven by the first rotary driving section 12 draws out the paper 2 held by the paper holding shaft 4 and then conveys the paper drawn out. The platen roller 5 is equivalent to a conveying section. Moreover, in this embodiment, the platen roller 5, the first rotary driving section 12 and a motor controller together (not shown) constitute a conveying section.

The roller section (ribbon roller) 6*a* of the ink ribbon 6 is arranged on the feed shaft 7 of the ink ribbon 6. The reeling shaft 8 is driven by the rotation of a second rotary driving section 15 (refer to FIG. 2) equipped with a motor 15*a* (refer to FIG. 2), gears and a conveyer belt. With the rotation of the reeling shaft 8, the ink ribbon 6 is coiled on the reeling shaft 8 and thereby drawn out from the roller section 6*a*. The ink ribbon 6 together with the paper 2 is clamped between the thermal head 9*a* and the platen roller 5.

The movable block 20 has a base member 22 for supporting the other members of the movable block. The head block 9 and the roller block 10 are mounted on the base member 22. The head block 9 has the thermal head 9*a* and a skeleton member 23 for supporting the thermal head 9*a*. On the other hand, the roller block 10 has guide rollers 10*a*, a buffer section 24 and a skeleton member 25 for supporting the guide rollers 10*a* and the buffer section 24. The skeleton members 23 and 25 are made up of, for example, a sheet metal structure.

The thermal head 9*a* is arranged above the platen roller 5 parallel to the platen roller 5. The thermal head 9*a*, which prints on the paper 2 drawn out by the platen roller 5, is equivalent to a printing section. The thermal head 9*a*, which is designed to be capable of contacting or departing from the thermal head 9*a*, applies a force to the platen roller 5 with an elastic member. The thermal head 9*a* subjected to the force of the elastic member presses the paper 2 located between the thermal head 9*a* and the platen roller 5 on the platen roller 5. The thermal head 9*a* is equipped with a plurality of heating elements that are arranged in one row, wherein the heating elements are selectively powered on to radiate heat. The thermal head 9*a* melts or sublimes the printing ink of the ink ribbon 6 with the heat radiated from the heating members, thereby transferring printing ink onto the drawn-out section 2*b* of the paper 2. In this embodiment, the thermal head 9*a* and the platen roller 5 constitute the printing and conveying section 13 which draws out the paper 2 by clamping the paper 2, and then conveys the paper 2 and prints on the paper 2. Moreover, in this embodiment, the thermal head 9*a*, the platen roller 5, the ink ribbon 6, the feed shaft 7, the reeling shaft 8, the second rotary driving section 15 and the motor controller (not shown) constitute a printing section.

Figure 5:
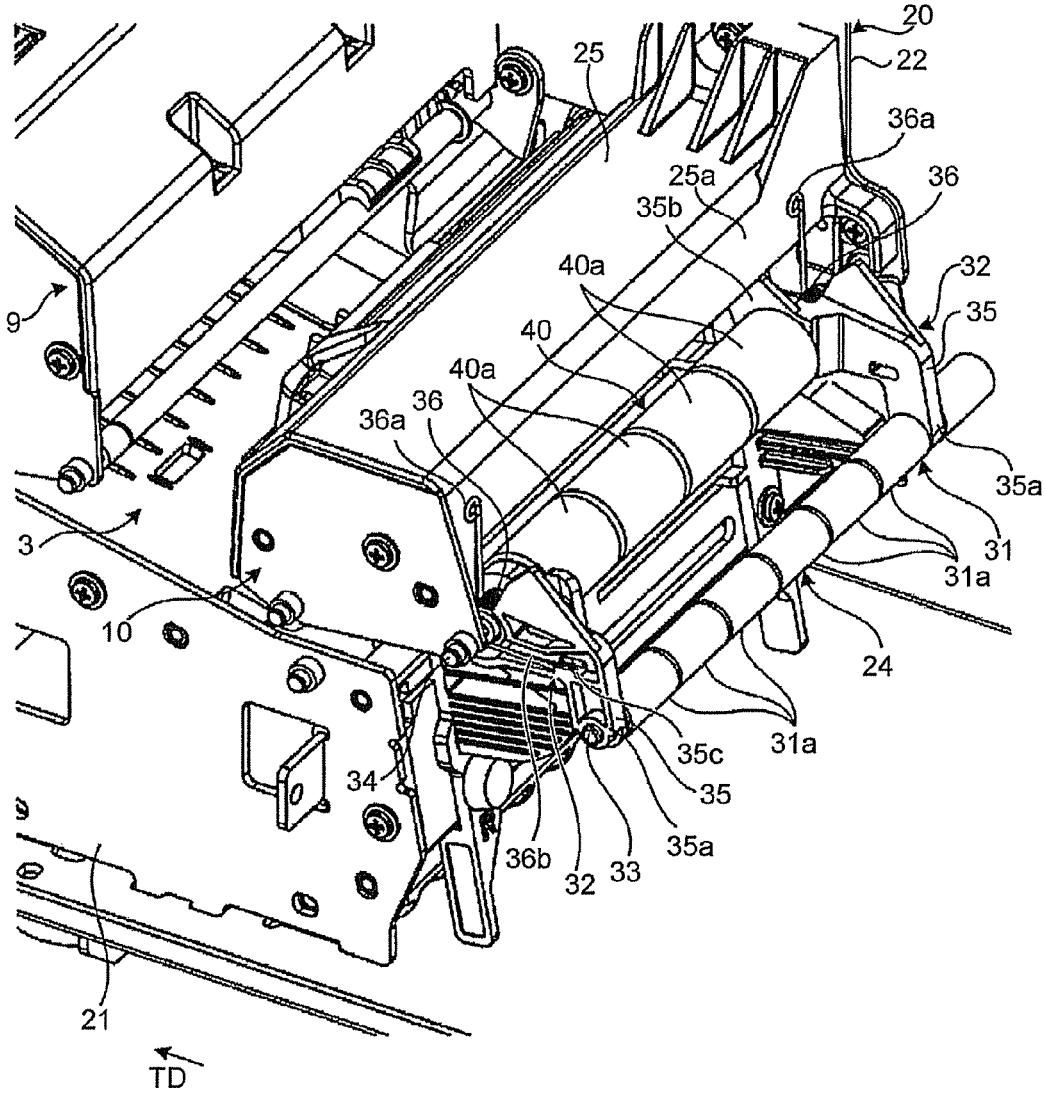
FIG. 5 is a perspective view showing a part of the head block of the printer observed from the back side according to an embodiment, wherein the head block is at a closing position.
Figure 6:
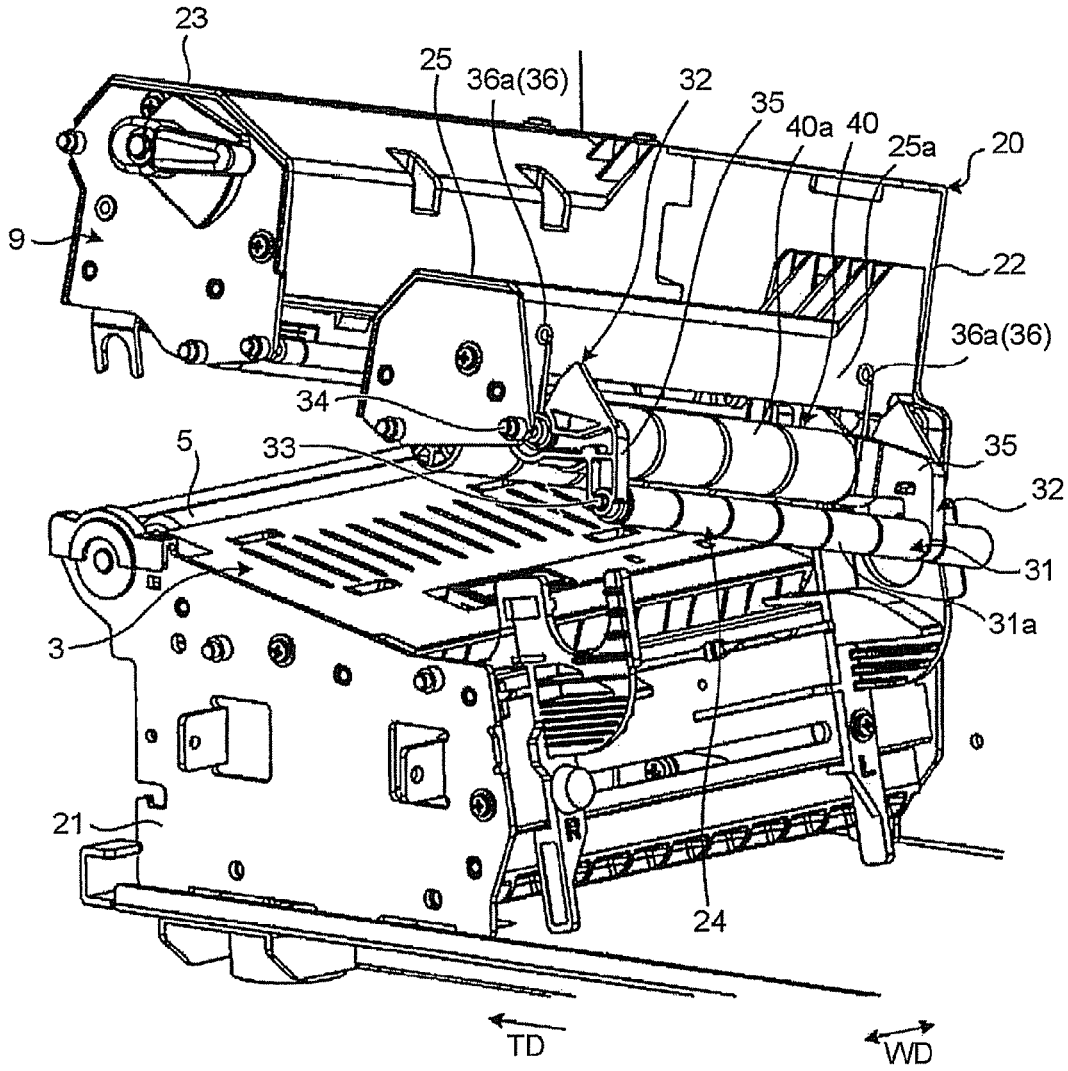
FIG. 6 is a perspective view showing a part of the head block of the printer observed from the back side according to an embodiment, wherein the head block is at an opening position.

As shown in FIG. 5 and FIG. 6, the buffer section 24 has a roller 31 serving as a propping member and a pair of left and right elastic support sections 32 that support the roller 31 elastically. The elastic support sections 32 are connected with the roller 31 in such a manner that each of the elastic support sections 32 can act separately (independently).

The roller 31 is arranged at the downstream side of the paper conveying direction TD of the paper holding shaft 4 and the upstream side of the paper conveying direction TD of the platen roller 5. Moreover, in this embodiment, the buffer section 24 is wholly arranged at the downstream side of the paper conveying direction TD of the paper holding shaft 4 and the upstream side of the paper conveying direction TD of the platen roller 5.

The roller 31 extends in the width direction WD of the paper 2 orthogonal to the paper conveying direction TD and is propped against the paper surface 2*c* (refer to FIG. 1) of the paper 2. The rotatable roller 31 supports the roller shaft 33. Specifically, the roller 31 has a plurality of running pulleys 31*a*, which are arranged in the width direction WD of the paper 2. The running pulleys 31*a* are separately and rotationally supported by the roller shaft 33. The roller 31 is equivalent to the propping member that is propped against the paper 2 to press the paper 2.

The pair of elastic support sections 32 are connected with the two ends of the roller 31 in the width direction. Specifically, one elastic support section 32 is connected with one end of the roller 31 in the width direction, and the other elastic support section 32 is connected with the other end of the roller 31 in the width direction. Moreover, the width direction of the roller 31 is the width direction WD of the paper 2. The pair of elastic support sections 32 elastically press the roller 31 on the paper surface 2*c* of the paper 2.

The elastic support section 32 comprises a support shaft 34, an arm member 35 serving as a rotor that is rotationally supported by the support shaft 34, and a torsion spring 36 serving as an elastic member for applying a force to the arm member 35. The pair of elastic support sections 32 share the same support shaft 34.

The support shaft 34 extends in the width direction WD of the paper 2 and is supported by the skeleton member 25. A guide roller 40 for guiding the paper 2 is arranged on the support shaft 34. The guide roller 40 is arranged at the downstream side of the paper conveying direction TD of the roller 31 and the upstream side of the paper conveying direction TD of the thermal head 9*a*. The guide roller 40 has a plurality of running pulleys 40*a*, each of which is arranged in the width direction WD of the paper 2 in a separately rotatable way and can be propped against the paper surface 2*c* of the paper 2.

The arm member 35 is rotationally supported by the support shaft 34 and is capable of rotating around the support shaft 34. An insertion hole for the insertion of the support shaft 34 is formed on the arm member 35. Here, the pair of arm members 35 are separately and rotationally supported by the same support shaft 34 and are therefore capable of rotating separately. The arm member 35 has a roller support section 35*a* extending from the rotational center part of the arm member and a positioning section 35*b* extending from the rotational center part of the arm member towards a side that is substantially opposite to the roller support section 35. The roller shaft 33 is inserted into the front end of the roller support section 35*a* that serves as one end (terminal) of the arm member 35. The pair of arm members 35 support the roller shaft 33, with one end thereof connected with the roller 31. The roller 31 is arranged between the pair of arm members 35.

Figure 7:
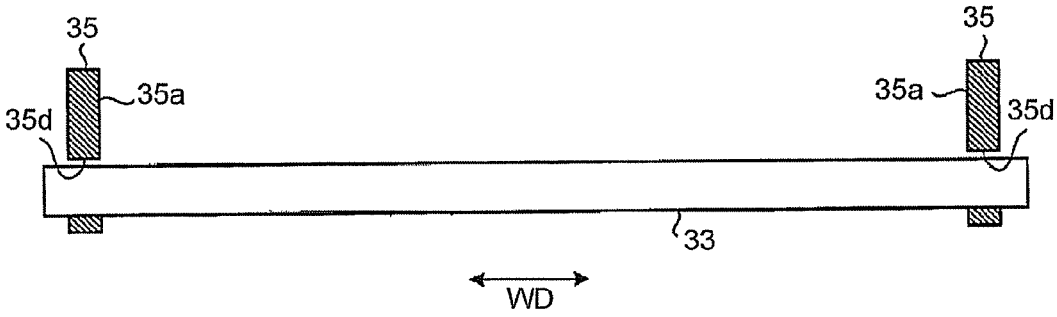
FIG. 7 is a rear sectional view showing a part of a buffer section according to an embodiment.
Figure 8:
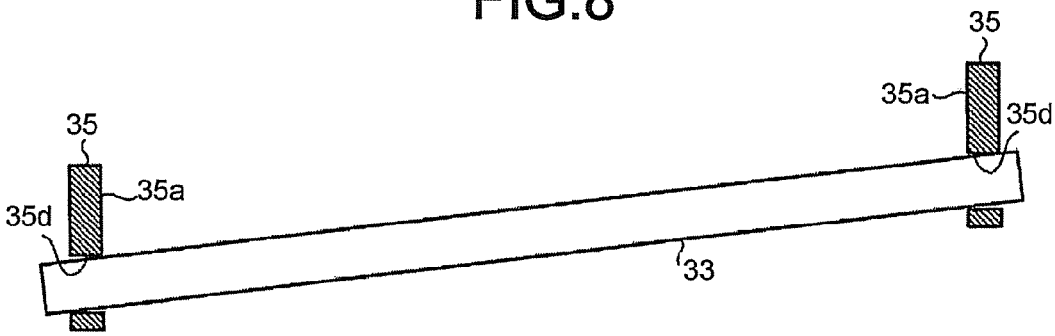
FIG. 8 is a rear sectional view showing a part of a buffer section according to an embodiment, wherein the roller shaft is inclined.

Here, the roller shaft 33 is embedded on the roller support section 35*a* of the arm member 5 in such a manner that the pair of elastic support sections 32 can act separately. Specifically, as shown in FIG. 7 and FIG. 8, an insertion hole 35*a* for the insertion of the roller shaft 33 is formed on the front end of the roller support section 35*a*. The diameter of the insertion hole 35*a* is greater than that of the roller shaft 33, resulting in a clearance between the insertion hole 35*a* and the roller shaft 33. In the structure above, when the arm members 35 are located at the same position in the vertical direction, the roller shaft 33 is substantially horizontal, and when one arm member 35 rotates upwards, the roller shaft 33 is inclined with respect to the horizontal line as one end of the roller shaft 33 is lifted by the arm member 35.

The torsion spring 36 is externally inserted on the support shaft 34. The carrier section 36*a* of one torsion spring 36 is supported by the wall part 25*a* of the skeleton member 25, and the carrier section 36*b* of the other torsion spring 36 is supported by a spring support section 35*c* formed on the roller support section 35*a*. The torsion spring 36 applies a force to the arm member 35 in the direction in which the paper surface 2*c* of the paper 2 is pressed by the roller 31. If there is no paper 2 placed, the positioning section 35*b* of the arm member 35 subjected to the force of the torsion spring 36 is propped against the wall part 25*a* of the skeleton member 25 to position the arm member 35.

The buffer section 24 with the structure above elastically supports the paper 2 by applying a force to the stopped paper 2 in the direction in which the paper 2 is endowed with a tension. Moreover, when the platen roller 5 starts to draw out and convey the paper 2, the paper 2 pulled by the platen roller 5 is pressed on the roller 32, and the roller support section 35*a* of the arm member 35 counteracts the force of the torsion spring 36 to rotate upwards (the direction indicated by the arrow R shown in FIG. 1). At this time, the torsion spring 36 elastically transforms to absorb the pull (load) of the drawn-out section 2*b* of the paper 2. In this way, the conveying load of the platen roller 5 is relieved.

At this time, if the width of the paper 2 is substantially equal to that of the roller 31 (the paper 2 is relatively wide), the roller support section 35*a* of each arm member 35 rotates upwards, and the torsion springs 36 absorb the pull (load) of the drawn-out section 2*b* of the paper 2. On the other hand, if the width of the paper 2 is smaller than that of the roller 31 (the paper 2 is relatively narrow), for instance, in the case where the width of the paper 2 is about ⅓ that of the roller 31, for the paper 2 that is conveyed close to an edge, the roller support section 35*a* of an arm member 35 rotates upwards, and a torsion spring 36 absorbs the pull (load) of the drawn-out section 2*b* of the paper 2 (FIG. 8). In this case, the roller support section 35*a* of the other arm member 35 does not rotate upwards, and the other torsion spring 36 does not absorb the pull (load) of the drawn-out section 2*b* of the paper 2. Thus, if the paper 2 is relatively wide, the roll section 2*a* of the paper has a relatively large mass load, the two torsion springs 36 are used to absorb the load. On the other hand, if the paper 2 is relatively narrow, as the mass load of the roll section 2*a* of the paper 2 is a relatively small, only one torsion spring 36 is needed to absorb the load.

As shown in FIG. 2, in addition to the first rotary driving section 12 and the second rotary driving section 15, a circuit substrate 16, which serves as a control section and is equipped with electronic parts such as a CPU (Central Processing Unit), and a power supply unit 17 are also accommodated in the second chamber S2. In the second chamber S2, the first rotary driving section 12 and the second rotary driving section 15 are arranged at the downstream side of the paper conveying direction TD while the circuit substrate 16 and the power supply unit 17 are arranged at the upstream side of the paper conveying direction TD.

Figure 3:
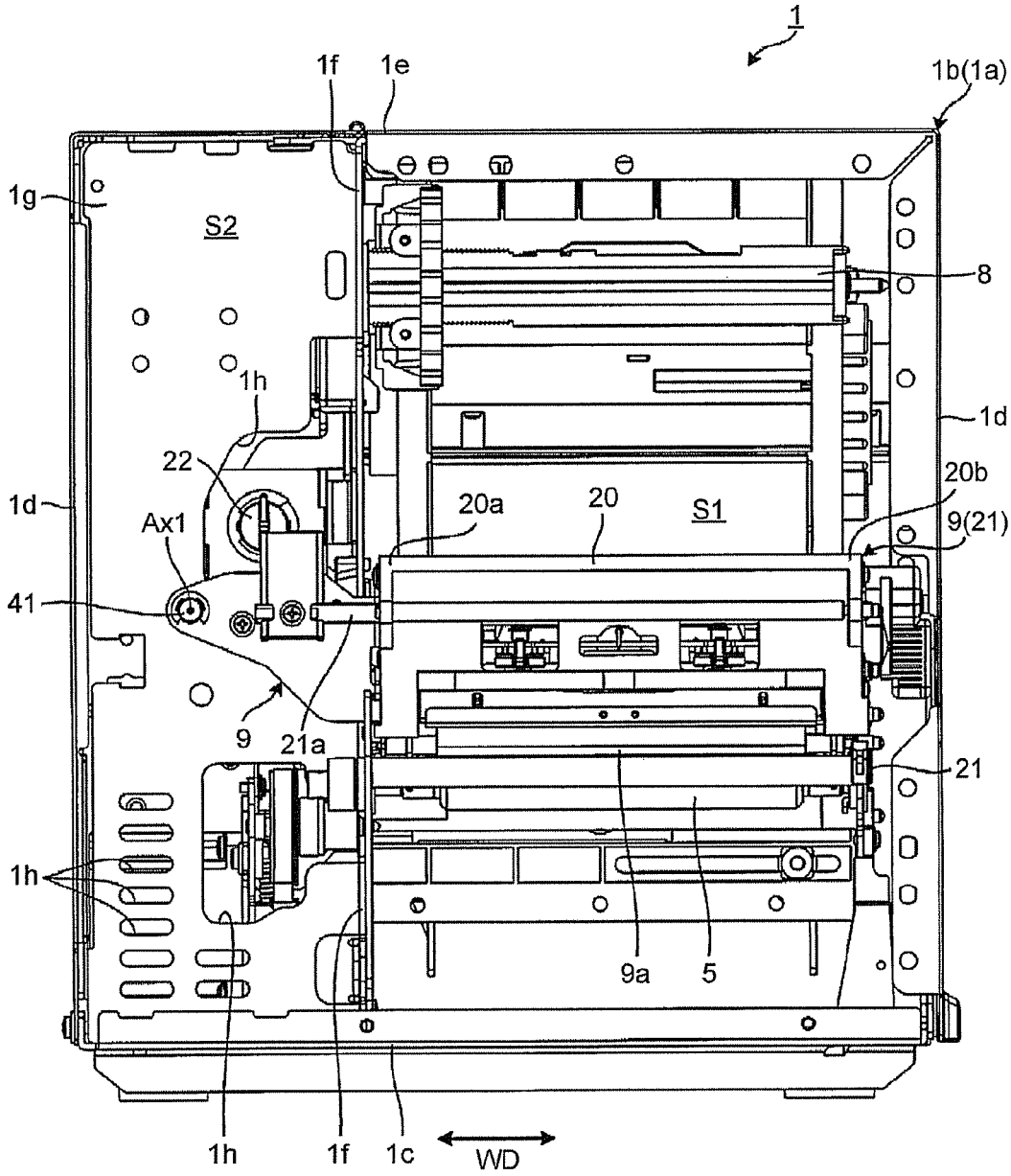
FIG. 3 is a front view showing an example of the internal structure of a printer according to an embodiment, wherein the head block of the printer is at a closing position.

As shown in FIG. 2 and FIG. 3, a partition wall 1*g* orthogonal to the longitudinal wall 1*f* and the bottom wall 1*c* is arranged in the second chamber S2 to separate the area at the upstream side of the paper conveying direction TD from the area at the downstream side of the paper conveying direction TD. A plurality of through holes 1*h* are arranged on the partition wall 1*g* to improve the ventilation in the second chamber S2.

Figure 4:
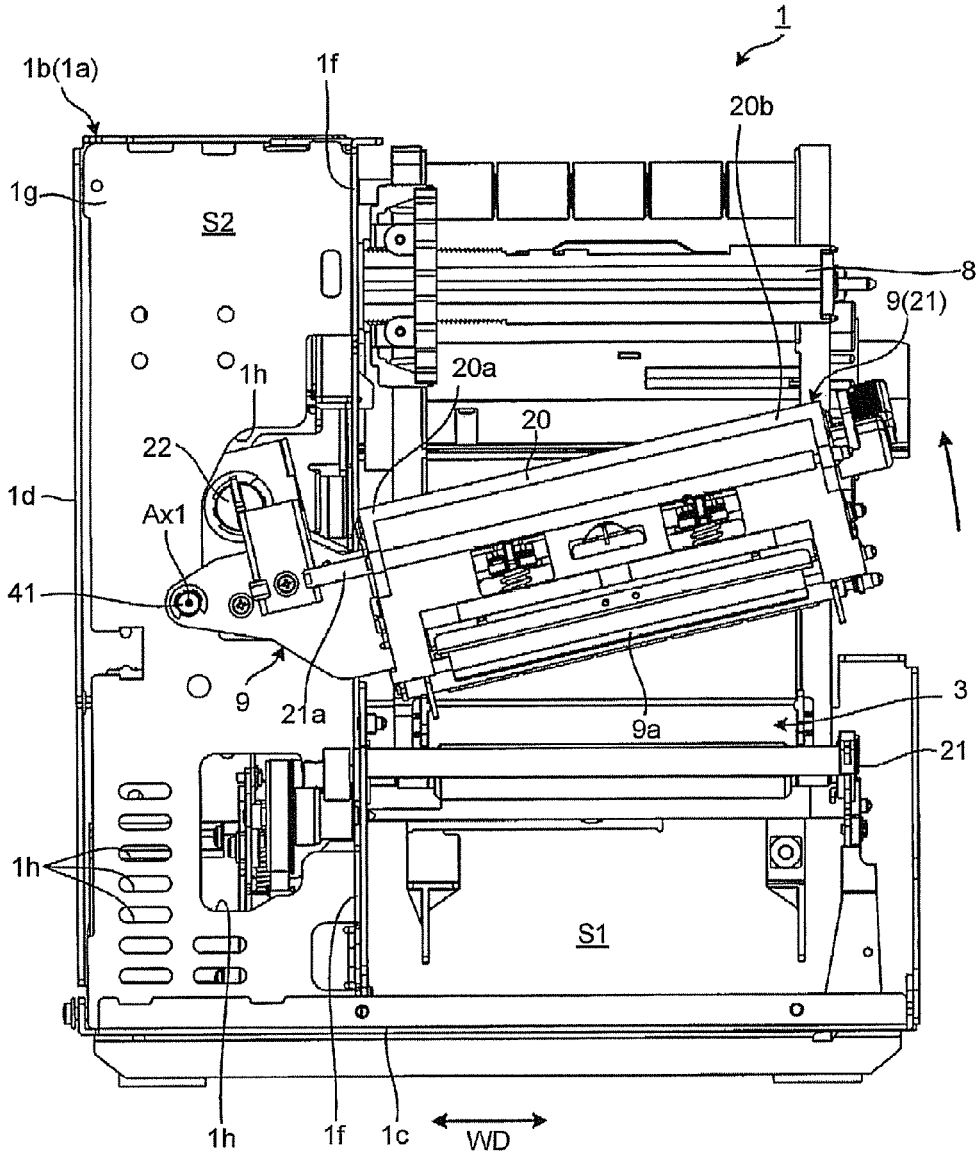
FIG. 4 is a front view showing an example of the internal structure of a printer according to an embodiment, wherein the head block of the printer is at an opening position.

Moreover, in this embodiment, as shown in FIG. 3 and FIG. 4, the end part 20*a* of the movable block 20 at one side of the width direction WD of the paper 2 is rotationally supported on the partition wall 1*g* and the front wall 1*i* of the second chamber S2 in such a state that the other end part 20*b* of the movable block 20 at the other side of the width direction WD of the paper 2 can be sprung upwards (to the top wall 1*e*). As shown in FIG. 2, the support shaft 41 is arranged between the partition wall 1*g* and the front wall 1*i* parallel to the longitudinal wall 1*f* and the bottom wall 1*e*. The movable block 20 is supported in such a manner that the movable block 20 can rotate around the central axis Ax1 (that is, the axis parallel to the longitudinal wall 1*f* and the bottom wall 1*e*) of the support shaft 41. In this case, the support shaft may be rotationally kept on the partition wall 1*g* and the front wall 1*i* or fixed on the partition wall 1*g* and the front wall 1*i*, and the movable block 20 may rotate around the support shaft 41. In this embodiment, the partition wall 1*g* and the front wall 1*i* are equivalent to a support member.

The movable block 20 may rotate between a closing position (FIG. 3 and FIG. 5) and an opening position (FIG. 4 and FIG. 5). The closing position is the position where the thermal head 9*a* is parallel to the platen roller 5. At the closing position, the thermal head 9*a* is parallel to the platen roller 5, the paper 2 is clamped, printed and conveyed by the thermal head 9*a* and the platen roller 5. On the other hand, the opening position is a position between the thermal head 9*a* and the platen roller 5 that is wider than the closing position, and at the opening position, the thermal head 9*a* is sprung up and therefore inclined with respect to the platen roller 5, and the part between the thermal head 9*a* and the platen roller 5 is opened. Thus, when the movable block 20 is at the opening position, as the part between the thermal head 9*a* and the platen roller 5 is opened, the paper 2 and the ink ribbon 6 can be set and replaced. At the closing position, the movable block 20 is fixed on the main body part 1*a* (housing 1*b*) of the printer 1. On the other hand, at the opening position, the other end part 20*b* at the other side of the width direction WD is away from the main body part 1*a* (housing 1*b*).

As stated above, in the printer 1 provided in this embodiment, the buffer section 24 is arranged on the movable block 20 equipped with the thermal head 9*a*. Therefore, by moving the movable block 20 to the closing position, the buffer section 24 is moved to the opening position to easily place the paper 2 on the paper conveying path 3. Moreover, as the buffer section 24 is arranged on the movable block 20 equipped with the thermal head, the printer 1 is structurally simplified when compared with printer equipped with a dedicated movable member for the buffer section 24.

Further, in this embodiment, the movable block 20 is rotationally supported by an end part in the width direction orthogonal to the paper conveying direction TD, and the other end part in the width direction can be bounced up. Therefore, the paper conveying path can be largely opened at the spring side to place the paper 2 on the paper conveying path 3 more easily.

Further, in this embodiment, the movable block 20 is equipped with guide rollers 10*a* and 40 for guiding the paper 2. Therefore, the guide rollers 10*a* and 40 rotate with the thermal head 9*a*, and consequentially, the paper 2 can be more easily placed on the paper conveying path 3.

Further, in this embodiment, the buffer section 24 is connected with the pair of elastic support sections 32 and the roller 31 in such a manner that the pair of elastic support sections 32 can act separately. Thus, the elastic support sections 32 both act when the paper 2 is relatively wide, and only one elastic support section 32 acts when the paper 2 is relatively narrow. As a result, different kinds of paper 2 with different widths can be dealt with, and the pulls of the different kinds of paper 2 can be well absorbed. Therefore, an excellent printing can be implemented on the different kinds of paper 2 with different width.

Moreover, in this embodiment, the arm member 35, which can rotate around the support shaft 34 and the end parts of which are connected with the roller 31, is subjected to the force of the torsion spring 36 in the direction in which the paper surface 2*c* of the paper is pressed. Thus, the force applied by the roller 31 to the paper 2 can be absorbed by the torsion spring 36 through the arm member 35.

Moreover, in this embodiment, the platen roller 5 which draws out and conveys the paper 2 is described as an example of the printing and conveying section 13, however, the present invention is not limited to this. For instance, in addition to the platen roller, the printing and conveying section 13 may be further provided with a conveying roller which draws out and conveys the paper independently or together with the platen roller 5.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A printer which can print on each of a plurality kind of papers whose widths are different from each other, the printer comprising:

a paper holding section configured to hold the paper rolled into a roll such that can draw out and convey the paper;

a printing and conveying section, which is provided with a print head and a platen roller that are arranged opposite to each other, draws out and conveys the paper and then prints on the paper;

a buffer section arranged at the downstream side of the paper conveying direction of the paper holding section and the upstream side of the paper conveying direction of the printing and conveying section to elastically press the paper surface of the paper; and a movable section equipped with a skeleton member and the print head and the buffer section and capable of rotating between a closing position opposite to the print head and the platen roller and an opening position that is located between the print head and the platen roller and is wider than the closing position, wherein the buffer section includes:

a propping member propped against the paper surface of the paper arranged at the downstream side of the paper conveying direction of the paper holding section and the upstream side of the paper conveying direction of the printing and conveying section, extending in the width direction of the paper orthogonal to the paper conveying direction, and a pair of elastic support sections that are connected with the two ends of the propping member in the width direction and elastically press the propping member on the paper surface of the paper, and the elastic support section includes:

a support shaft supported by the skeleton member;

a rotor which can rotate around the support shaft and has a support section connected with the propping member and a positioning section; and an elastic member which applies a force to the rotor in the direction in which the paper surface of the paper is pressed by the propping member, and when the propping member is not propped against the paper surface of the paper, the positioning section of the rotor subjected to the force of the elastic member is propped against the skeleton member to position the rotor, and the propping member is a roller that can be rotationally supported by a roller shaft, and the roller shaft is embedded on the rotor in such a manner that the pair of elastic support sections can act separately, and when the paper whose width is equal to or greater than a predetermined value is conveyed, each of a pair of the support sections of a pair of the rollers rotates upwards, and a pair of the elastic members absorb a load of the paper, and when the paper whose width is smaller than the predetermined value is conveyed, the support section of one of the pair of the rollers rotates upwards, and one of the pair of the elastic members absorbs the load of the paper, and the support section of the other of the pair of the rollers does not rotate upwards, and the other of the pair of the elastic members does not absorb the load of the paper.

2. The printer according to claim 1, wherein the movable block is rotationally supported by an end part in the width direction orthogonal to the paper conveying direction, and the other end part in the width direction can be bounced up.

3. The printer according to claim 1, wherein the movable section is provided with guide rollers for guiding the paper.

4. The printer according to claim 3, wherein the buffer section is provided with a propping member which is propped against the paper to press the paper; and the guide rollers are configured at the downstream side of the paper conveying direction of the propping member and the upstream side of the paper conveying direction of the print head.

5. The printer according to anyone of claim 1, wherein the buffer section is arranged at the downstream side of the paper conveying direction of the paper holding section and the upstream side of the paper conveying direction of the conveying section, extends in the width direction of the paper orthogonal to the paper conveying direction, and is provided with the propping member propped against the paper surface of the paper and a pair of elastic support sections that are connected with the two ends of the propping member in the width direction to elastically press the propping member on the paper surface of the paper; and the pair of elastic support sections are connected with the propping member in such a manner that the pair of elastic support sections can act separately.

6. The printer according to claim 5, wherein the elastic support section includes:

a rotor, which can rotate around the support shaft, and the end parts of which are connected with the propping member; and an elastic member which applies a force to the rotor in the direction in which the paper surface of the paper is pressed by the propping member.

* * * * *